US007874546B2

(12) United States Patent
Park

(10) Patent No.: US 7,874,546 B2
(45) Date of Patent: Jan. 25, 2011

(54) INTEGRATED NANO-BUBBLE GENERATING APPARATUS

(76) Inventor: Jong Hoo Park, Sungin Villa B025, 241-8, Yubang-dong, Yongin City, Kyunggi Do (KR)

( * ) Notice: Subject to any disclaimer, the term of this patent is extended or adjusted under 35 U.S.C. 154(b) by 99 days.

(21) Appl. No.: 12/222,991

(22) Filed: Aug. 21, 2008

(65) Prior Publication Data

US 2009/0051055 A1 Feb. 26, 2009

(30) Foreign Application Priority Data

Aug. 22, 2007 (KR) ..... 10-2007-0084320
Jul. 25, 2008 (KR) ..... 10-2008-0073026

(51) Int. Cl.
*B01F 3/04* (2006.01)

(52) U.S. Cl. ..... 261/28; 261/37; 261/64.3; 261/66; 261/122.1; 261/123; 261/DIG. 74

(58) Field of Classification Search ..... 261/28, 261/37, 64.3, 66, 119.1, 122.1, 123, DIG. 7, 261/DIG. 74
See application file for complete search history.

(56) References Cited

U.S. PATENT DOCUMENTS 1,965,470 A * 7/1934 Roberts ..... 261/35
2,168,187 A * 8/1939 Auger ..... 261/28
3,412,741 A * 11/1968 Mills ..... 137/1
6,135,433 A * 10/2000 Nurmi ..... 261/128
6,209,855 B1 * 4/2001 Glassford ..... 261/28
7,246,793 B2 * 7/2007 Nagasaka et al. ..... 261/36.1
2003/0122268 A1 * 7/2003 Nagasaka et al. ..... 261/122.1
2004/0124548 A1 * 7/2004 Rona et al. ..... 261/64.3
2006/0284325 A1 * 12/2006 Kohama et al. ..... 261/122.1
2009/0293920 A1 * 12/2009 Watanabe ..... 134/102.1

FOREIGN PATENT DOCUMENTS

JP 61-24414 A * 2/1986 ..... 261/119.1
JP 3-52696 A * 3/1991 ..... 261/119.1
JP 2005-177062 7/2005
JP 2007-000546 1/2007
JP 2007-143747 6/2007
KR 10-0787042 12/2007
KR 10-0844870 7/2008

* cited by examiner

*Primary Examiner*—Richard L Chiesa
(74) *Attorney, Agent, or Firm*—Jacobson Holman PLLC

(57) ABSTRACT

An integrated nano-bubble generating apparatus including a pressure tank integrated with components constituted as a system and a power portion to be selectively adapted to a system so as to enlarge the use scope of the system, which includes an integrated bubble generating portion including a three-directional electronic valve supplying water flowing in an inflowing pipe to any one of a bubble generating portion and the power portion, a pressure sensing portion sensing a pressure in the inflowing pipe, a first vacuum chamber providing outer air to a pressure tank, a power control portion controlling the three-directional electronic valve, the pressure sensing portion and the first vacuum chamber and the pressure tank mixing water and air under an inner predetermined pressure and shattering water, physically, to generate nano-bubble water; and the power portion including a pump operated by a motor to supply water flowing in the inflowing pipe to the bubble generating portion and a second vacuum chamber supplying outer air via a check valve.

9 Claims, 7 Drawing Sheets

INTEGRATED NANO-BUBBLE GENERATING APPARATUS

BACKGROUND OF THE INVENTION

The invention is related to providing an integrated nano-bubble generating apparatus comprising a pressure tank integrated with components constituted as a part of the system and a power portion to be selectively adapted to a system so as to enlarge the use scope of the system.

PRIOR ARTS

There have developed various nano-bubble generators to generate much amount of bubble from water in bath to obtain the same effect as a massage. A typical nano-bubble generating apparatus is disclosed in Korea Patent No. 787042.

As shown in FIG. 1, the nano-bubble generating apparatus 100 includes a control portion 120 operating a water supplying valve 115 and receiving sensing signals of a pressure and a temperature in a pressure tank 121 from a pressure sensor 122 and a temperature sensor 123. At the same time, the control portion 120 operates a pump 112 generating a pumping force by a motor 111 and supplying a storage water w via a suction tool, a water supplying pipe 114, a water balancer 116 and a connecting pipe 117 in turn to the pressure tank 121. The pressure tank 121 has a constant pressure in the inner portion by the water inflow into the inner portion, and the inner pressure is adjusted with a bleeder mounted on its upper surface. In order to form the constant pressure in the pressure tank 121, an air supplying pipe 119 and a vacuum chamber 130 between the water supplying valve 115 and the pump 112 is connected in turn at the same time to flow outer air pressurized at a predetermined pressure into the pump 112. Herein, the outer air is first filtered and purified passing through an air purifying filter 132 and supplied to an air supplying control valve 133. The air supplying control valve 133 senses a water pressure in a water pressure acting pipe 111 connected to the connecting pipe 117 so that it supplies an amount of purified air from the air purifying filter 132 to the vacuum chamber 130. The nano-bubble water from the pressure tank 121 is supplied through a discharging pipe 128 to a bath containing supplying water w.

Therefore, the nano-bubble generating apparatus 100 enables the inner pressure of the pressure tank 121 to be formed at a constant pressure and generate a predetermined amount of nano-bubble water. The nano-bubble generating apparatus 100 has an advantage in stabilizing a system.

But, the nano-bubble generating apparatus 100 must maintain the ready state for a predetermined time period from the time point of starting a system until the inner pressure in the pressure tank 121 reaches a constant value, which results from deteriorating the commodity quality. Also, the nano-generating apparatus 100 must be provided with the pump 112 and structural elements arranged in a dispersed form, which limits its use and service.

In light of these and those points, it is preferable if the structural elements are unified in a compact arrangement to be adapted to a water faucet and a shower tap. The adaption to the water faucet and the shower tap has several careful and attentive points.

A tap water may be boiled with barley, corn or tea leaves for the purpose of sterilizing even a little amount of noxious substance to drink safely. Another boiling purpose is to remove the smell of disinfectant and/or the leaving for a day after the boiling of the water makes volatile matters disappeared. Another method is to use purified filters such as charcoal.

On the other hand, spring water has been recommended as good water, because it contains rich oxygen and minerals. In these respects, the good water can be defined into types of water that minerals such as Calcium, Magnesium, Natrium, etc. are dissolved in abundant, even a little amount of noxious substance or smell are removed and it has anti-active oxygen function to remove the active oxygen.

In these views, a typical Korean Patent No. 0844870 (Korean Patent Application No. 2007-19209) owned by this applicant discloses a nano-bubble purifier generating hexagonal water and a large amount of nano-bubble functioning to remove the active oxygen, so the disadvantages of prior arts can be resolved. For it, the nano-bubble purifier mounted on a purifier is structured to process water in a storage tank and supply nano-bubble water to users.

In other words, a pump introduces purified water through a T-characterized connecting pipe thereinto, in which the T-characterized connecting pipe is connected to a vacuum chamber to mix the purified water with outer air purified by a filter and oxygen or carbon gas separately supplied from their storage tanks. The gas mixed and purified water is flowed into the pump to be shattered, physically, and again supplied to the water storage. A vacuum chamber is connected to an outer air supplying portion for supplying air purified from an air purifying filter. The outer air supplying portion includes an air supplying pipe and an air supplying valve, which is connected to a water pressure operating pipe at the outlet of the pump to be controlled in response to the operation of the pump.

As described above, the nano-bubble generating portion comprises a small vacuum chamber mounted at the water supplying side of the motor pump, but because the inner portion of the vacuum chamber is small, the nano-bubble generating portion has a disadvantage in that it is difficult to maintain the inner portion of the vacuum chamber at the vacuum state or a predetermined pressurized state for a predetermined period. To it, the air supplying control valve connected to the outer air supplying pipe must be precisely controlled by an outer electronic control signal.

In light of these points, it is preferable if a nano-bubble generator is constructed in a compact arrangement that an outer air supplying portion or an air supplying pipe, a vacuum chamber and a pressure tank are integrated in one unit.

It is preferable if a nano-bubble generator includes a pressure tank integrally provided with crusher shattering water.

It is very innovative if a nano-bubble generator generates a large amount of nano-bubble water containing a predetermined micro or nano-size, for example 10 to 30μ even with being directly connected to a water supplying pipe having a constant water pressure or at home.

In consideration of these and those points, a main object of the invention is to provide an integrated nano-bubble generating apparatus comprising a pressure tank integrated with components constituted as a system and a power portion to be selectively adapted to a system so as to enlarge the use scope of the system.

Another object of the invention is to provide to provide an integrated nano-bubble generating apparatus directly connected to a water faucet having a constant water pressure and comprising a pressure tank integrated with an air supplying portion for forming the inner portion of the pressure tank into a negative pressure state so as to generate nano-bubbles.

Another object of the invention is to provide an integrated nano-bubble generating apparatus including a pressure tank integrated with at least one crusher for physically shattering water supplied thereinto at least one time to generate nano-bubbles.

SUMMARY OF THE INVENTION

According to the invention, an integrated nano-bubble generating apparatus comprises an integrated bubble generating portion including a three-directional electronic valve supplying water flowing in an inflowing pipe to any one of a bubble generating portion and a power portion, a pressure sensing portion sensing a pressure in the inflowing pipe, a first vacuum chamber providing outer air to a pressure tank, a power control portion controlling the three-directional electronic valve, the pressure sensing portion and the first vacuum chamber and the pressure tank mixing water and air under an inner predetermined pressure and shattering water, physically, to generate nano-bubble water; and a power portion including a pump operated by a motor to supply water flowing in the inflowing pipe to the bubble generating portion and a second vacuum chamber supplying outer air via a check valve with air flowing in an air supplying pipe to the pump and an electronic control portion controlling the check valve and the second vacuum chamber, in which the integrated bubble generating portion is direct-coupled to a water faucet or a shower tap to generate nano-bubble water only with subsistence water being physically shattered a few times without the power portion.

An integrated nano-bubble generating portion comprises the pressure tank including an air check valve forming the inner portion thereof as a vacuum chamber to generate the negative pressure, an air spraying nozzle mounted on the upper surface thereof to flow an outer air thereinto and a spray mounted on the upper surface thereof to pressurize and spray water from an inflowing pipe; and a bubble generating control portion mounted on the lower portion of the pressure tank and including an upside-down T-shaped body, in which a first vertical guide passage is formed at the inlet portion to introduce drinkable water or water for life such as showering water and guide into a vacuum chamber, a micron water generator mounted at the outlet portion of the first vertical guide passage to shatter the drinkable water or water for life in a micron size, a crusher shattering mixing water containing a large amount of nano-bubbles mixed with outer air in a micron size, a second guide passage mounted at the inlet portion to guide the mixing water from the crusher into a horizontal discharging passage, and a cylinder including a first communicating port connected with the first guide passage, a second communicating port connected with the second guide passage and a piston mounted in the inner space thereof.

The air check valve includes a body, a ring portion mounted at one side to the upper surface of the body to support the check valve and a cap portion fixed to another side of the ring portion and including a net portion formed on the upper surface thereof to supply outer air to the check valve and a plurality of slits formed around the middle portion thereof.

The micron water generator comprises a pipe including one end connected to the first guide passage and the other end formed as a spraying port, the height portion of which is substantially lower than one of the vacuum chamber, and a threaded net member including a length portion of a predetermined width and spirally positioned in the pipe.

The water crusher includes a minute through-hole formed at the center and a plurality of grooves formed around the circumference thereof and is fitted into the inner portion of the second guide passage.

According to another embodiment, a water crusher comprises a nozzle body having a stepped jaw at the middle portion to form two spaces; a nozzle portion including three groups of one ring and two net members stacked with each another to form at least three venturi spaces at the upper portion of the nozzle body and a nozzle having three minute holes formed thereon adjacent the upper portion of the body; and nozzle holes formed at a predetermined gap around the lower circumference of the nozzle body on the lower nozzle body having a vacant inner portion, in which the nozzle body includes a flange formed around the upper end thereof to be mounted the second passage with a small gap being formed between the nozzle body and the inner portion of the second guide passage.

The bubble generating control portion includes a first vertical guide passage extended from a water inlet portion, a second vertical guide passage extended from a water outlet portion and a horizontal portion having a space in which the piston is mounted.

The micron water generating portion includes a body connected at the inlet portion to a motor pump to introduce the drinkable water and water for life thereinto.

BRIEF DESCRIPTION OF THE DRAWINGS

The invention now will be described in detail with reference to the accompanying drawings, in which.

DETAILED DESCRIPTION OF THE INVENTION

Figure 1:
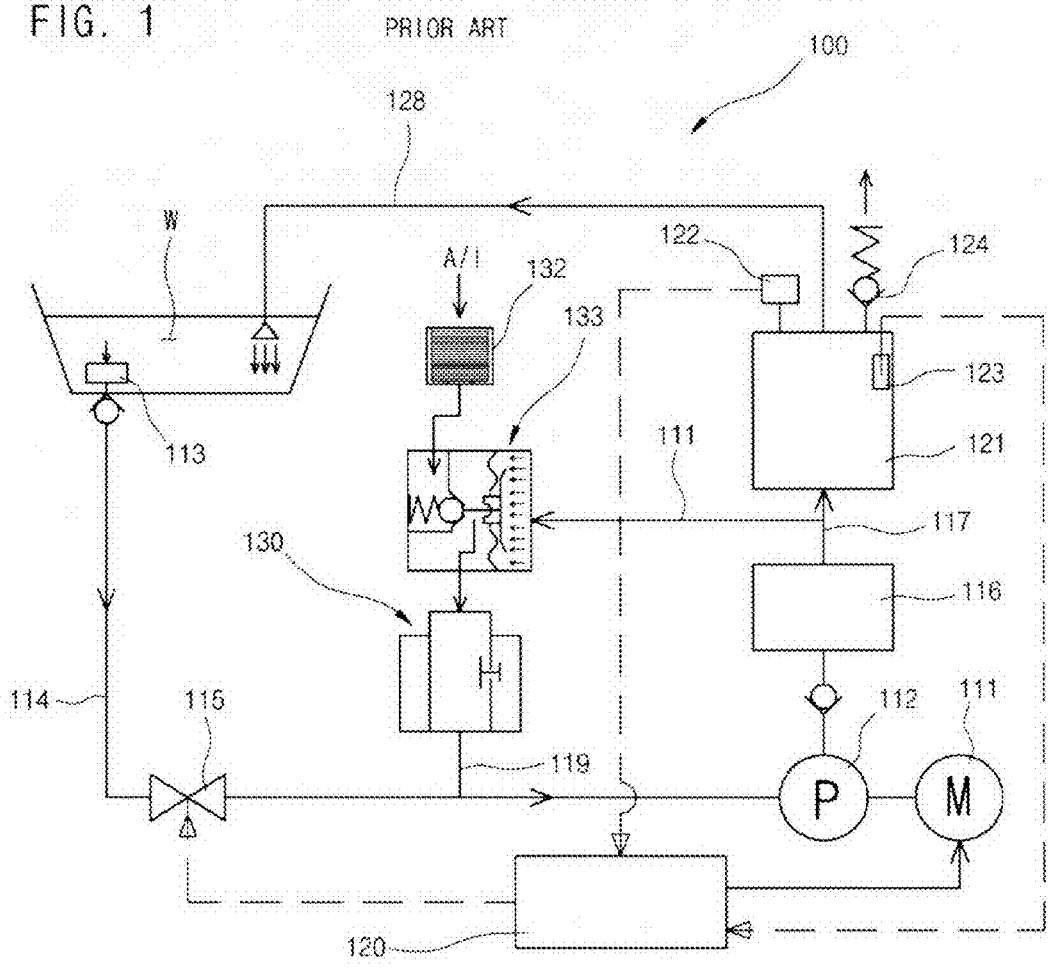
FIG. 1 PRIOR ART
FIG. 1 is a block diagram illustrating a whole system of a nano-bubble generating apparatus according to a prior art.
Figure 2:
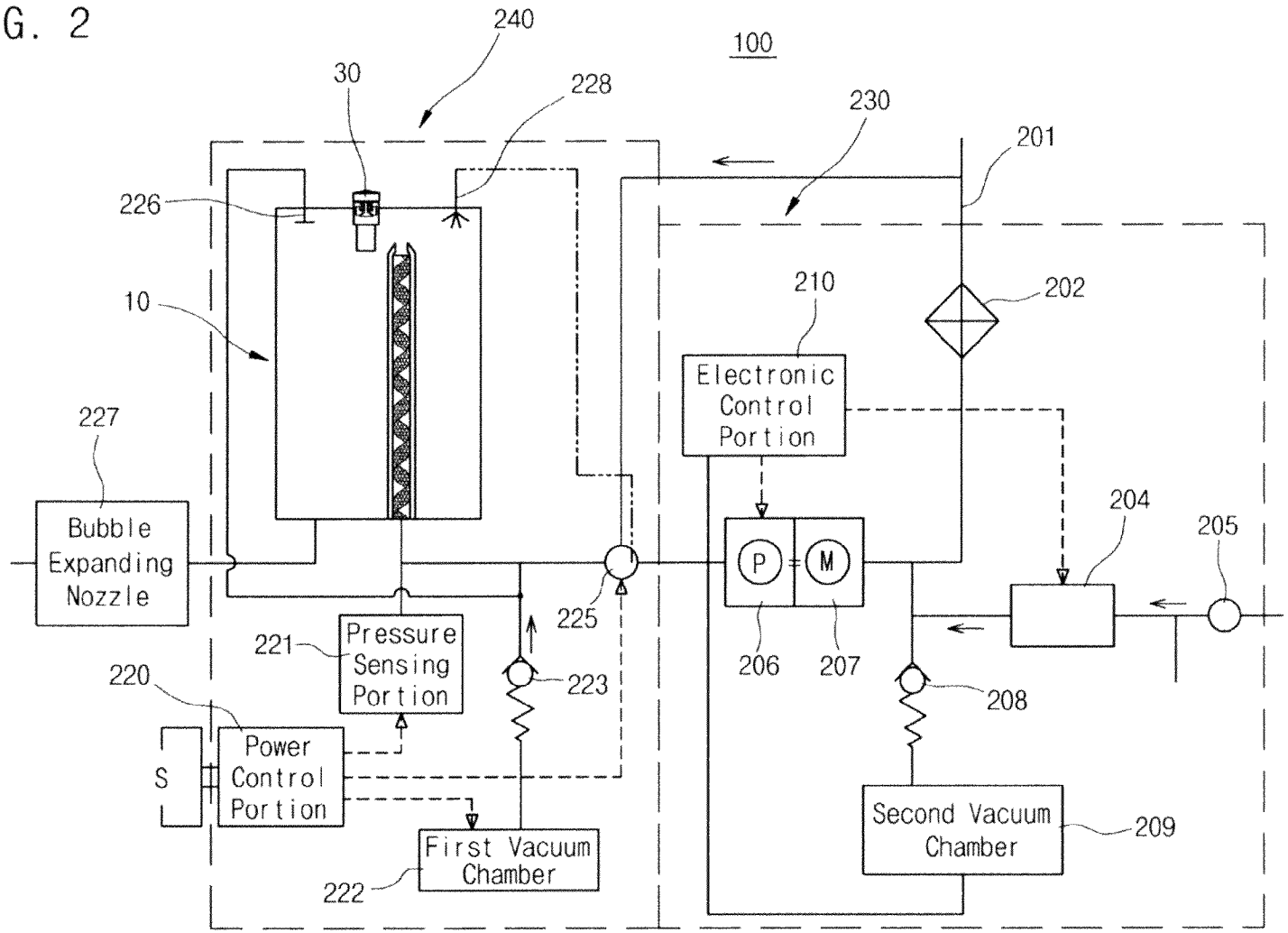
FIG. 2 is a block diagram illustrating a whole system of an integrated nano-bubble generating apparatus according to the invention.

As shown in FIG. 2, an integrated nano-bubble generating apparatus 100 comprises a power portion 230 and a bubble generating portion 240. The power portion 230 is operated under the system control of an electronic control portion 210, in which the electronic control portion 210 operates a pump 206 starting a motor 207 and then the pump 206 flows water in an inflowing pipe 201 and through a purifying filter 202 into the inner portion thereof. At the same time, the electronic control portion 210 controls an electronic valve 204 and a second vacuum chamber 209 to supply air from an air supplying pipe 205 and pressurizing air from the second vacuum chamber 209 through a check valve 208 into the pump 206. The pump 206 mixes water with air to supply mixing water to a pressure tank 10 in the bubble generating portion 240.

The bubble generating portion 240 includes a power control portion 220 to enable the operation of a system, independently. The power control portion 220 controls a three directional electronic valve 225 to introduce inflowing water flowing in an inflowing pipe 201 into the pressure tank 10, directly. Further, the power control portion 220 operates a pressure sensing portion 221 to sense a water pressure formed in the inflowing pipe 201 and judge whether the motor 207 is operated. The power control portion 220 also operated a first vacuum chamber 222 supply pressurized outer air through the check valve 223 and an air spraying nozzle 226 to the pressure tank 10. The pressure tank 10 provides mixing water containing a large amount of nano-bubbles or nano-bubble containing water through a bubble expanding nozzle 227 to users, in which the bubble expanding valve 227 is a spraying nozzle to be adapted to a shower.

Figure 3:
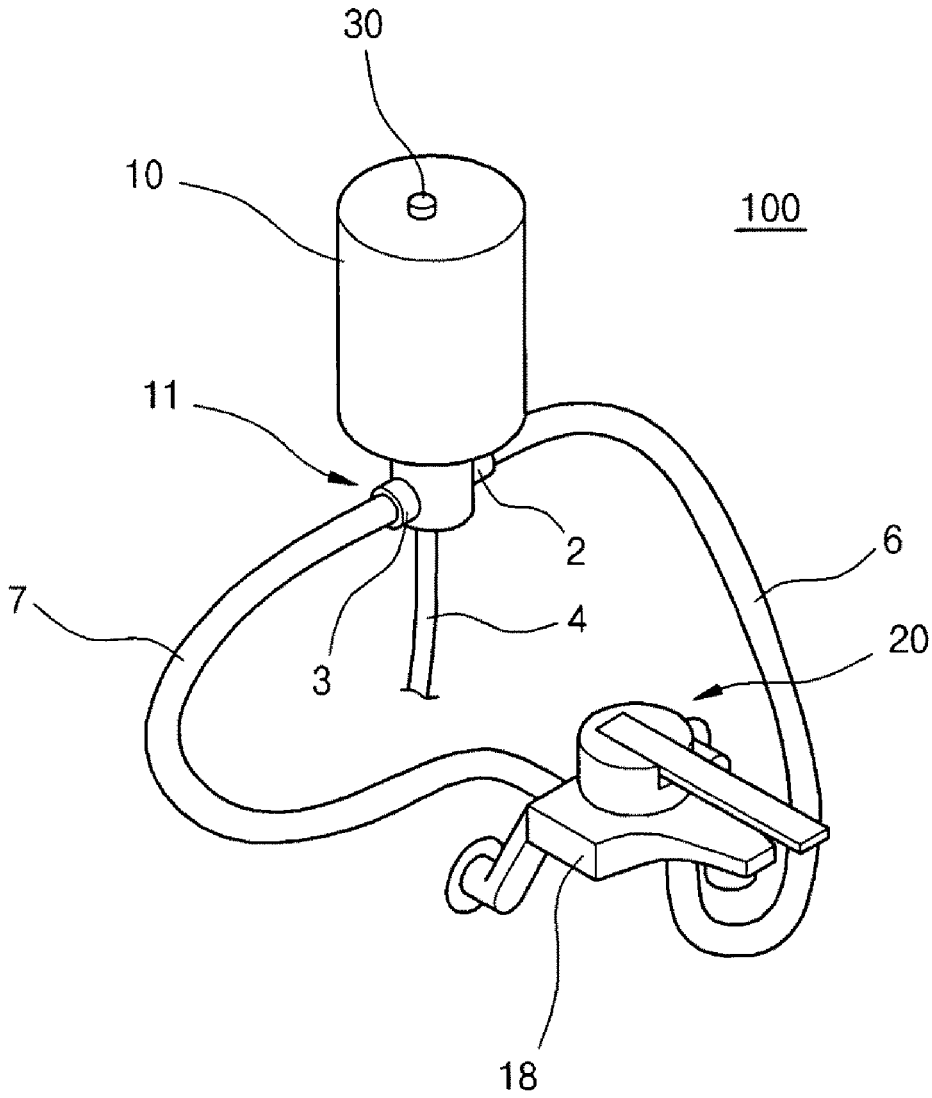
FIG. 3 is a view illustrating one embodiment of an integrated nano-bubble generating apparatus directly connected to a water faucet according to the invention.

As shown in FIG. 3, a nano-bubble generating apparatus 100 is mounted adjacent to a water facet 20 to be directed thereto. The nano-bubble generating apparatus 100 comprises a pressure tank 10, on the lower portion of which a bubble generating control portion 11 is mounted. The bubble generating control portion 11 includes an inlet portion 2 and an outlet portion 3 formed on both sides thereof and a discharging port formed on the lower portion thereof.

The inlet portion 2 is coupled with an inflowing pipe 6 linked from a mounting portion 18 formed as a water facet 20. The outlet portion 3 discharges nano-bubbles containing water therefrom as described below in detail. The outlet portion 3 is coupled with a supplying pipe 7. Therefore, the nano-bubbles containing water is again supplied to the water facet 20 to be used as drinkable water or water for life.

Figure 4:
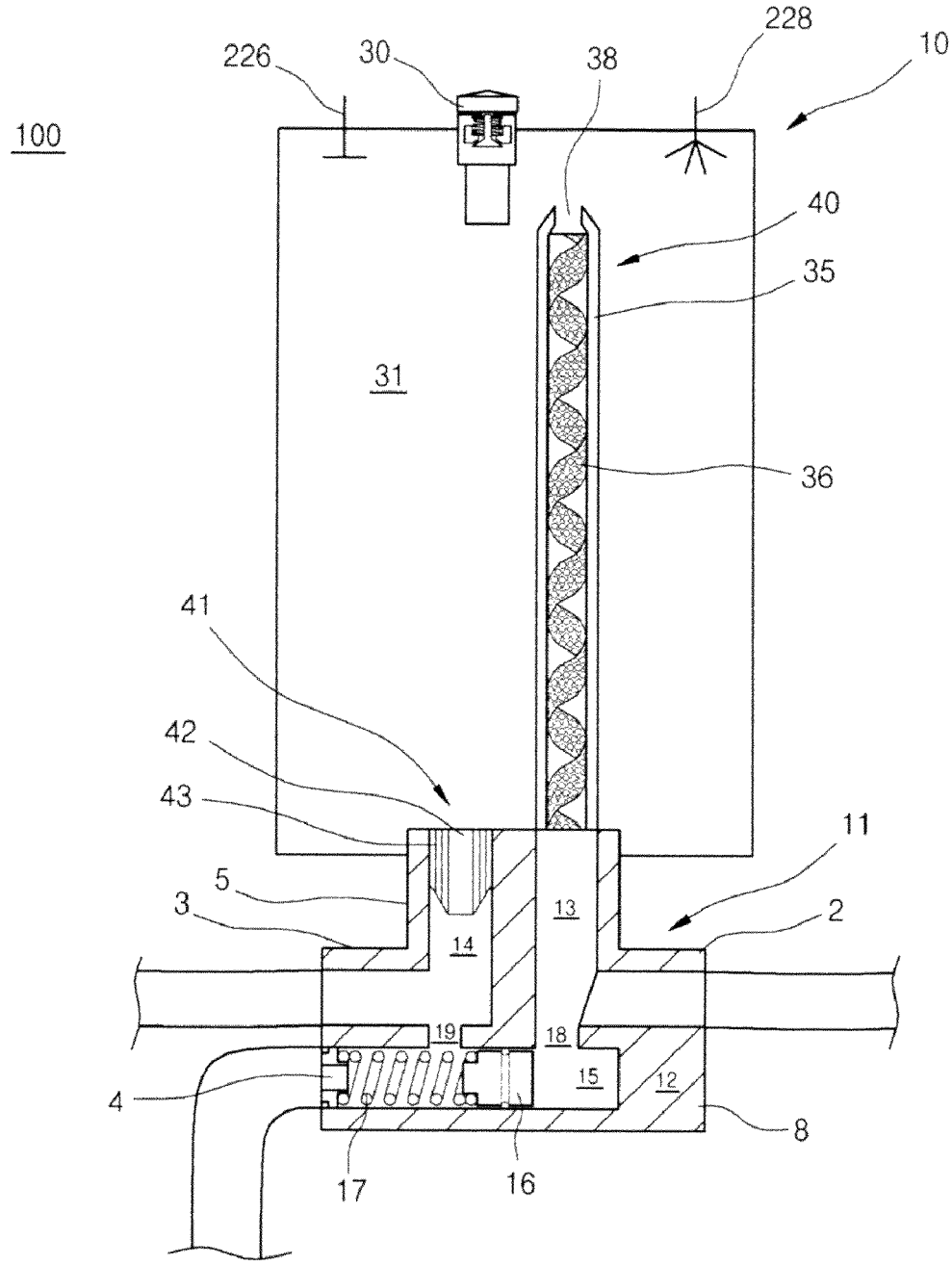
FIG. 4 is a detailed view illustrating an integrated nano-bubble generating portion according to the invention.

As shown in FIG. 4, in order to produce the nano-bubbles containing water, a nano-bubble generating apparatus 100 includes a pressure tank 10 and a bubble generating control portion 11. the pressure tank 10 includes further an air nozzle 226 introducing an outer air thereinto and a sprayer 228 pressurizing and spraying water from the inflowing pipe 201 except that the bubble generating control portion 11 is mounted on the lower portion of the pressure tank 10 and the air check valve 30 is mounted on the upper surface of the pressure tank 10.

The bubble generating control portion 11 includes an upside-down T-shaped body 12. In the vertical portion of the body 12, there are formed a first guide passage 13 leading from the inlet portion 2 into the pressure tank 10 and a second guide passage 14 leading from the pressure tank 10 into the outlet portion 3. In a horizontal portion under the vertical portion 5, there is formed a cylinder 15. The cylinder 5 includes a piston 16 elastically supported by a spring therein, a first communicating port 18 communicated with the first guide passage 13 at the front of the piston 16 and a second communicating port 19 communicated with the second guide passage 14 at the rear of the piston 16. Therefore, the piston 16 closes a discharging port 4 to block the second communication port 19 if the drinkable water flowing into the outlet portion 2 has a pressure of over 1.5 $Kg/cm^2$. The pressure tank 10 is constituted as a vacuum chamber 31 having a predetermined negative pressure, on the upper surface of which an air check valve 30 is mounted to form the negative pressure in the pressure tank 10 with the sprayer 228.

Figure 5:
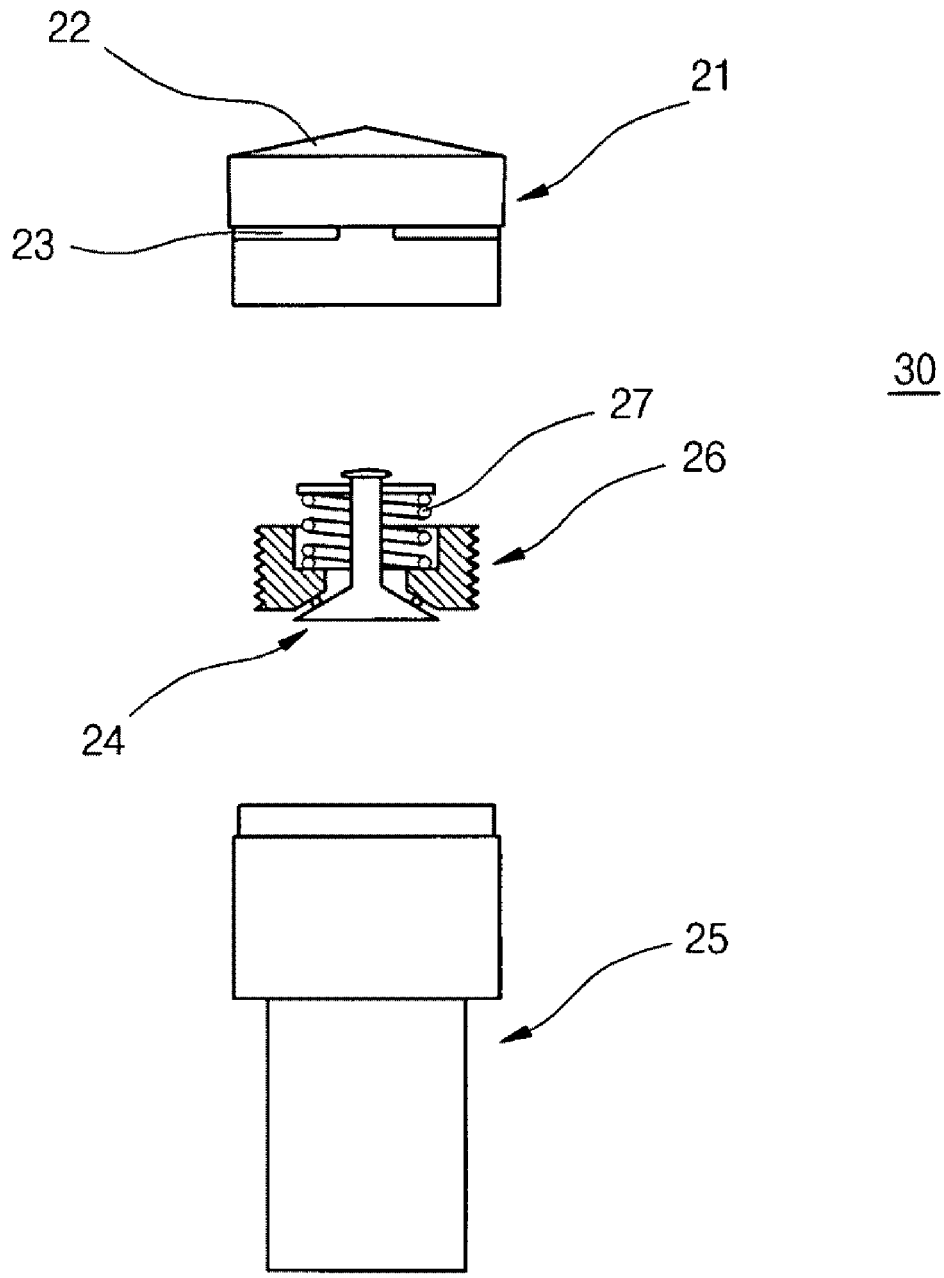
FIG. 5 is an exploded perspective view illustrating an air check valve assembled in a part according to the invention.

As shown in FIG. 5, the air check valve 30 includes a check valve body 25 receiving a check valve 24 therein. A ring portion 26 includes a threaded portion formed around the outer circumference and the check valve 24 elastically supported by a spring therein. The check valve body 25 receives the ring portion 26 threadedly inserted therein. A cap portion 21 is threadedly coupled with the upper portion of the ring portion 26, on the upper portion of which a net member 22 is mounted and on the middle circumference of which at least one slits 23 are formed. The air check valve 30 is mounted on the upper surface of the pressure tank 10 to be communicated with the vacuum chamber 31, and the check valve 24 closes the vacuum chamber 31 until reaching a predetermined negative pressure therein, in which the negative pressure means a time point capable of generating the nano-bubbles.

Referring to FIG. 4, again, the pressure tank 10 is coupled with the bubble generating control portion 11, in which the micron water generator 40 is mounted adjacent to the terminal end of the first guide passage 13 to generate nano-bubbles. The micron water generator 40 includes a hollow pipe 35 having a height somewhat smaller than the inner full length of the vacuum chamber 31 and a threaded net member 36 inserted into the hollow pipe 35, at the upper end of which a nozzle hole 38 is formed. In the upper terminal end of the second guide passage 14 there is mounted a distributing orifice 41. The distributing orifice 41 also shatters the nano-bubbles containing water in a more minute size, finally, and includes a minute hole 42 in the center and a number of grooves 43 formed around the circumference thereof.

Figure 6:
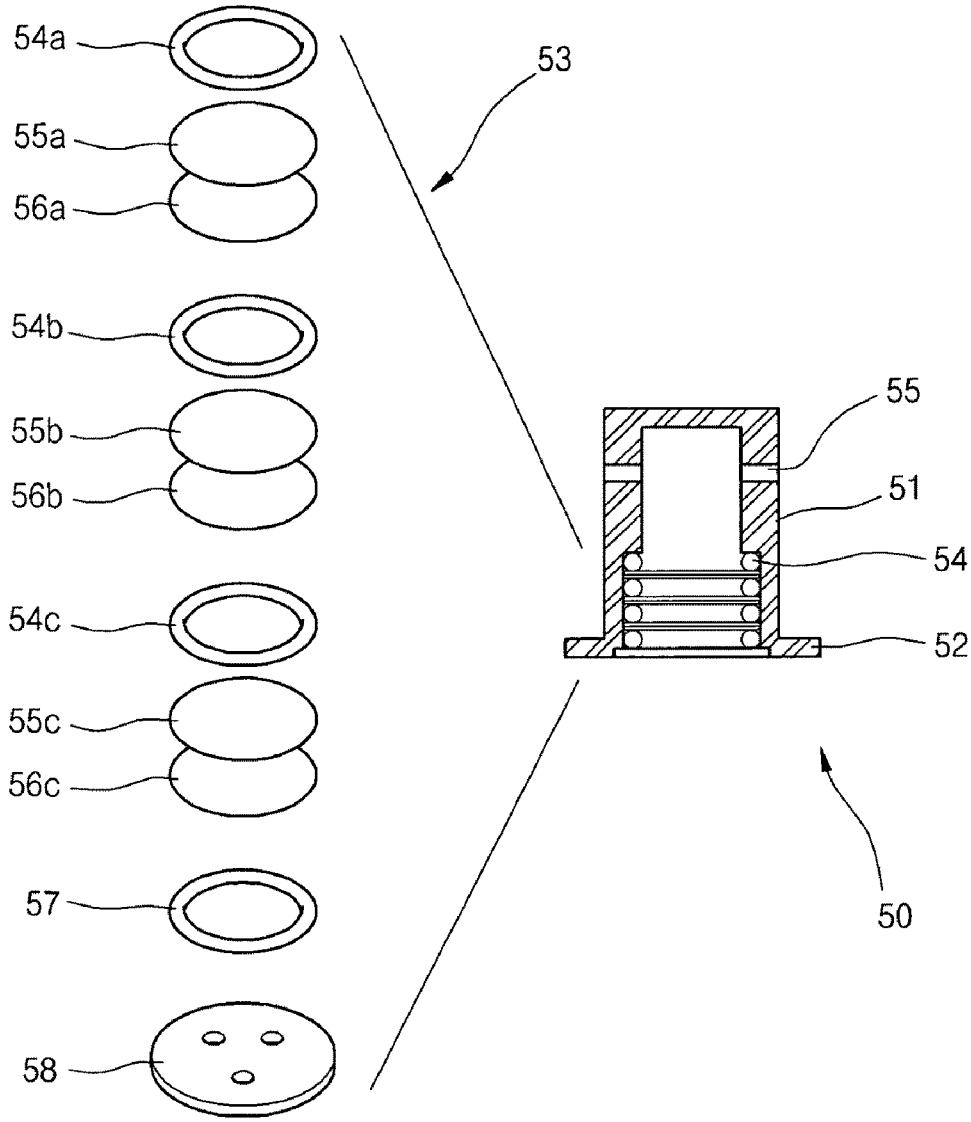
FIG. 6 is an exploded perspective view illustrating a water crusher according to one embodiment of the invention; and, FIG. 7 is a detailed view illustrating an integrated nano-bubble generating portion adapting a motor pump according to another embodiment of the invention.

As shown in FIG. 6, a nozzle crusher 50 is fitted into the second guide passage 14 instead of the distributing orifice 41. The nozzle crusher 50 includes a nozzle body 51 with a lower portion being closed and an upper portion forming a flange 52. The nozzle body 51 is drawn in the upside-down state, but the upper flange 52 is positioned on the inlet portion of the second guide passage 14 in the outlet portion 3. In the nozzle body 51 there is formed a stepped jaw 54 to mount the nozzle portion 53. A plurality of venturi holes 55 are formed below the stepped jaw 54 around the circumference of the nozzle body 51. The nozzle portion 53 is constituted in four groups. A first group including a first ring **54*a* and first disks 55*a* and 56 that are constituted as a pair of minute net members are piled up one upon another on the stepped jaw 54, a second group including a second ring 54*b* and paired second disks 55*b* and 56*b* overlapped to one another is positioned on the first group, a third group including a third ring 54*c* and paired third disks 55*c* and 56*c* overlapped to one another is positioned on the second group. Next, a fourth ring 57 and a nozzle 58 having a predetermined number of minute holes are positioned in turn on the third group. The nozzle crusher 50 is fitted into the terminal end portion of the second guide passage 14 to form a minute gap between the inner wall and the nozzle body 51. Therefore, the nozzle crusher 50** generates nano-bubbles containing water shattered in a more minute size, physically.

Furthermore, the nano-bubble generating apparatus 100 is combined with a power portion 230 to generate a larger amount of nano-bubble. To it, nano-bubbles containing water pressurized by a pump 206 and passing through an inflowing pipe 201 is supplied to a sprayer 228 to spray the water in the pressure tank 10. Simultaneously, an air nozzle 226 sprays pressurized air in the pressure tank 10 to mix minutely shattered water with the pressurized air, vividly.

The nano-bubble generating control portion 11, the micron water generating portion 35, the distributing orifice 41 or the nozzle crusher 50 and the check valve 30 are integrally combined in a proper arrangement to the inner and/or outer portion of the pressure tank 10 to complete the nano-bubble generating apparatus 100. The nano-bubble generating apparatus 100 is mounted on the water faucet 20 to introduce drinkable water or water having a predetermined pressure for life into the inlet portion 2 of the nano-bubble generating control portion 11, move the piston 16 backward and close the discharging port 4. Then, the drinkable water flowing in the first guide passage 13 is shattered and sprayed by the threaded net member 36 and the nozzle hole 37 passing through the micron water generating portion 35 to generate nano-bubbles. The nano-bubbles containing water is diffused and filled up from the lower to the upper to form the negative pressure in the vacuum chamber 31. At that time, the pressurized air is vividly combined with the nano-bubbles containing water to produce much more nano-bubbles containing water. Thereafter, as the negative pressure is formed over a predetermined value in the vacuum chamber 31, the air check valve 30 starts to be operated so that air flowed from the air check valve 30 is combined with the nano-bubbles containing water to continuously produce much more nano-bubbles containing water. The nano-bubbles containing water is more shattered passing through the distributing orifice 38 or the nozzle crusher 50 and supplied through the second guide passage 14 to the water faucet 20 as good drinkable water or water for life having a size of about 10μ.

A discharging port 4 discharges residual water in the pressure tank 10 by opening the second communicating hole 19, when the drinkable water is not supplied or the pressure against the piston 16 in the cylinder 15 is released.

Figure 7:
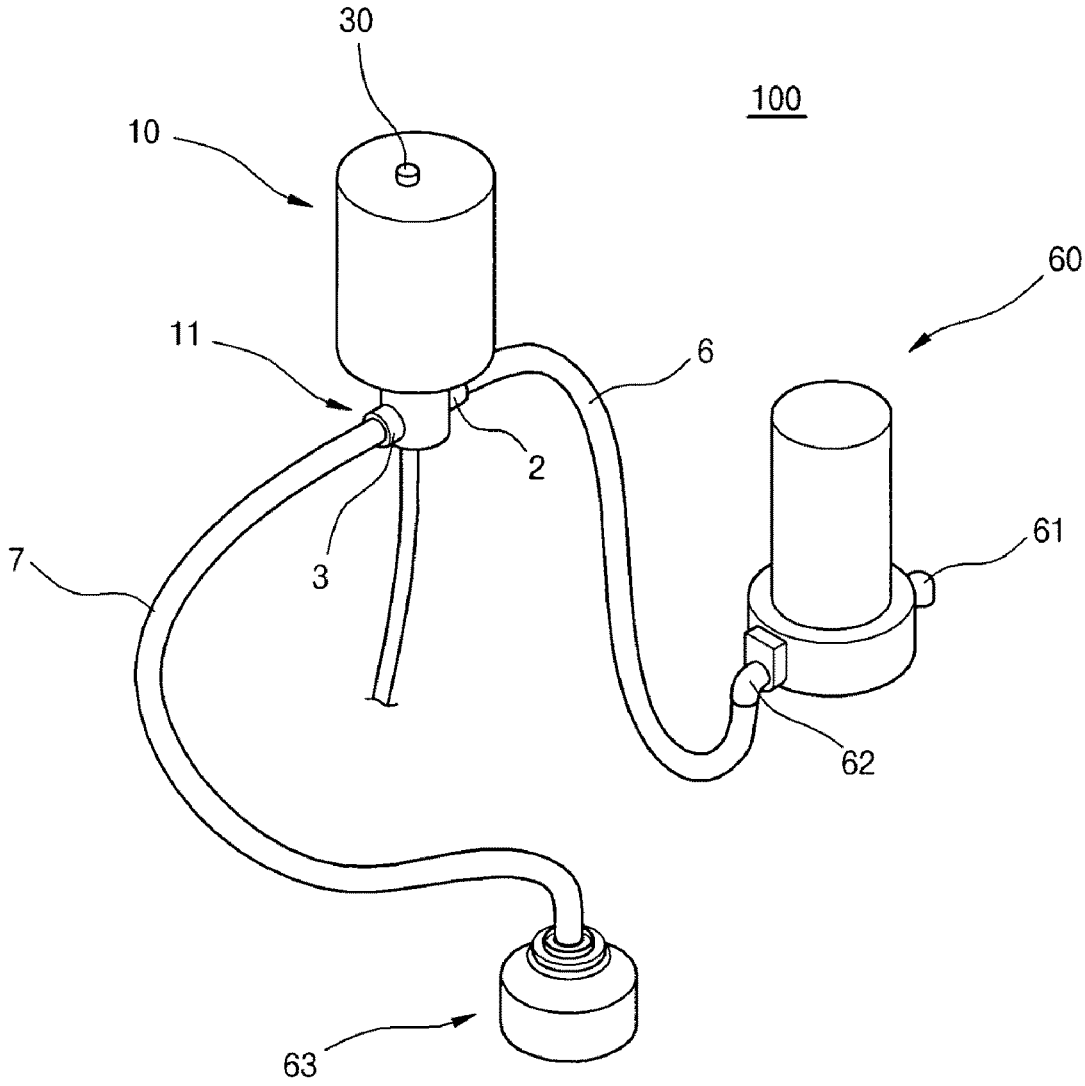

As shown in FIG. 7, a nano-bubble generating apparatus 100 can be combined with a motor pump 60 if a water pressure in a water faucet 20 is below a predetermined value, or if it is adapted to a shower requesting a relative higher pressure. And, the nano-bubble generating apparatus 100 may be provided in a manner to couple an inlet side 61 of the motor pump 60 to the water faucet 20 for a shower head portion 63 and an outlet side 62 through the inflowing pipe 6 to the inlet portion 2 of the nano-bubble generating control portion 11. To the outlet portion 3 of the nano-bubble generating control portion 11 the shower 63 and/or the water faucet 20 can be connected.

As described above, the invention enables the selection of a power portion including a motor pump to generate a larger amount of nano-bubbles and can be directed to a water faucet or a shower tool to produce a good drinkable water or water for life by having faucet water or water for life contain a larger amount of negative-ions, removing noxious substances therefrom and preserving inherent mineral components in water without damaging. Also, the invention enables a nano-bubble generating apparatus to be constructed in one unit in a manner that all elements or components are mounted on the inner and/or outer portions of a pressure tank or adjacent to a pressure tank.

What is claimed is:

1. An integrated nano-bubble generating apparatus comprising:

an integrated bubble generating portion including a three-directional electronic valve supplying water flowing in an inflowing pipe to any one of a bubble generating portion and a power portion, a pressure sensing portion sensing a pressure in the inflowing pipe, a first vacuum chamber providing outer air to a pressure tank, a power control portion controlling the three-directional electronic valve, the pressure sensing portion and the first vacuum chamber and the pressure tank mixing water and air under an inner predetermined pressure and shattering water, physically, to generate nano-bubble water; and the power portion including a pump operated by a motor to supply water flowing in the inflowing pipe to the bubble generating portion and a second vacuum chamber supplying outer air via a check valve with air flowing in an air supplying pipe to the pump and an electronic control portion controlling the check valve and the second vacuum chamber, in which the integrated bubble generating portion is direct-coupled to a water faucet or a shower tap to generate nano-bubble water only with subsistence water being physically shattered a few times without the power portion.

2. The integrated nano-bubble generating apparatus as claimed in claim 1, in which:

the integrated nano-bubble generating portion comprises;

the pressure tank including an air check valve forming the inner portion thereof as a vacuum chamber to generate the negative pressure, an air spraying nozzle mounted on the upper surface to flow an outer air therein and a spray mounted on the upper surface to pressurize/spray water from an inflowing pipe; and a bubble generating control portion mounted on the lower portion of the pressure tank and including an upside-down T-shaped body, in which a first vertical guide passage is formed at the inlet portion to introduce drinkable water or water for life and guide into a vacuum chamber, a micron water generator mounted at the outlet portion of the first vertical guide passage to shatter the drinkable water and water for life in a micron size, a crusher shattering mixing water containing a large amount of nano-bubbles mixed with outer air in a micron size, a second guide passage and a cylinder including the crusher mounted at the inlet portion to guide the mixing water into a horizontal discharging passage, and a cylinder including a first communicating port connected with the first guide passage, a second communicating port connected with the second guide passage and a piston mounted in the inner space thereof.

3. The integrated nano-bubble generating apparatus as claimed in claim 2, in which:

the air check valve includes a body, a ring portion mounted at one side to the upper surface of the body to support the check valve and a cap portion fixed to another side of the ring portion and including a net portion formed on the upper surface thereof to supply outer air to the check valve and a plurality of slits formed around the middle portion thereof.

4. The integrated nano-bubble generating apparatus as claimed in claim 2, in which:

the micron water generator comprises a pipe including one end connected to the first guide passage and the other end formed as a spraying port, the height portion of which is substantially lower than one of the vacuum chamber, and a threaded net member including a length portion of a predetermined width and spirally positioned in the pipe.

5. The integrated nano-bubble generating apparatus as claimed in claim 2, in which:

the water crusher includes a minute through-hole formed at the center and a plurality of grooves formed around the circumference thereof and is fitted into the inner portion of the second guide passage.

6. The integrated nano-bubble generating apparatus as claimed in claim 2, in which:

the water crusher comprises a nozzle body having a stepped jaw at the middle portion to form two spaces; a nozzle portion including three groups of one ring and two net members stacked with each another to form at least three venturi spaces at the upper portion of the nozzle body and a nozzle having three minute holes formed thereon adjacent the upper portion of the body; and nozzle holes formed at a predetermined gap around the lower circumference of the nozzle body on the lower nozzle body having a vacant inner portion, in which the nozzle body includes a flange formed around the upper end thereof to be mounted the second passage with a small gap being formed between the nozzle body and the inner portion of the second guide passage.

7. The integrated nano-bubble generating apparatus as claimed in claim 2, in which:

the nano-bubble generating control portion includes the first vertical guide passage extended from a water inlet portion, the second vertical guide passage extended from a water outlet portion and a horizontal portion having a space in which the piston is mounted.

8. The integrated nano-bubble generating apparatus as claimed in claim 2, in which:

the micron water generator includes a body connected at the inlet portion to a motor pump to introduce the drinkable water and the water for life thereinto.

9. The integrated nano-bubble generating apparatus as claimed in claim 4, in which:

the water crusher comprises a nozzle body having a stepped jaw at the middle portion to form two spaces; a nozzle portion including three groups of one ring and two net members stacked with each another to form at least three venturi spaces at the upper portion of the nozzle body and a nozzle having three minute holes formed thereon adjacent the upper portion of the body; and nozzle holes formed at a predetermined gap around the lower circumference of the nozzle body on the lower nozzle body having a vacant inner portion, in which the nozzle body includes a flange formed around the upper end thereof to be mounted the second passage with a small gap being formed between the nozzle body and the inner portion of the second guide passage.

* * * * *